US011331906B2

(12) United States Patent
Koide et al.

(10) Patent No.: US 11,331,906 B2
(45) Date of Patent: May 17, 2022

(54) LIQUID DISCHARGE HEAD AND LIQUID DISCHARGE APPARATUS

(71) Applicant: Brother Kogyo Kabushiki Kaisha, Nagoya (JP)

(72) Inventors: Shohei Koide, Nagoya (JP); Keita Hirai, Nagoya (JP); Keita Sugiura, Toyokawa (JP); Hiroshi Katayama, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/819,507

(22) Filed: Mar. 16, 2020

(65) Prior Publication Data

US 2020/0307182 A1 Oct. 1, 2020

(30) Foreign Application Priority Data

Apr. 1, 2019 (JP) ..... JP2019-069623

(51) Int. Cl.

*B41J 2/14* (2006.01)
*B41J 2/18* (2006.01)
*B41J 2/045* (2006.01)

(52) U.S. Cl.

CPC ..... *B41J 2/04541* (2013.01); *B41J 2/04581* (2013.01); *B41J 2/14201* (2013.01); *B41J 2/18* (2013.01); *B41J 2002/14419* (2013.01); *B41J 2202/12* (2013.01)

(58) Field of Classification Search

CPC ..... B41J 2202/12; B41J 2/18
See application file for complete search history.

(56) References Cited

U.S. PATENT DOCUMENTS

2019/0009554 A1* 1/2019 Nakagawa ..... B41J 2/175

FOREIGN PATENT DOCUMENTS

JP 2008-290292 A 12/2008
JP 2019166820 A * 10/2019 ..... B41J 2/18
WO WO-2020189695 A1 * 9/2020 ..... B41J 2/14

* cited by examiner

*Primary Examiner* — Shelby L Fidler
(74) *Attorney, Agent, or Firm* — Banner & Witcoff, Ltd.

(57) ABSTRACT

A liquid discharge head includes: a supply manifold; a feedback manifold; and a plurality of individual flow channels. Each of the individual flow channels includes: a supply portion, a descender portion, and a feedback portion. The supply manifold has a plurality of supply ports, and the feedback manifold has a plurality of feedback ports. A distance between the center of the supply manifold in one direction and the plurality of supply ports of the supply manifold is longer than ¼ of a width of the supply manifold in the one direction, and a distance in the one direction between the center of the feedback manifold in the one direction and the plurality of feedback ports of the feedback manifold is shorter than ¼ of a width of the feedback manifold in the one direction.

16 Claims, 7 Drawing Sheets

LIQUID DISCHARGE HEAD AND LIQUID DISCHARGE APPARATUS

CROSS REFERENCE TO RELATED APPLICATION

The present application claims priority from Japanese Patent Application No. 2019-069623, filed on Apr. 1, 2019, the disclosure of which is incorporated herein by reference in its entirety.

BACKGROUND

Field of the Invention

The present disclosure relates to liquid discharge heads configured to discharge a liquid such as an ink or the like onto a medium, and liquid discharge apparatuses including such a liquid discharge head.

Description of the Related Art

There is known an ink jet recording apparatus having an ink jet recording head and an ink tank. The ink jet recording head and the ink tank are connected by a supply tube and a circulation tube. The ink sent from the ink tank to the ink jet recording head via the supply tube is sent back from the ink jet recording head to the ink tank via the circulation tube. In this manner, by circulating the ink, the ink is prevented from drying. Inside the ink jet recording head, there are provided a supply manifold to supply the ink to a plurality of pressure chambers, and a feedback manifold to discharge the ink which is not jetted from the nozzles among the ink supplied to the pressure chambers. The supply manifold is in communication with the supply tube, while the feedback manifold is in communication with the circulation tube. Note that in the ink jet recording apparatus as described above, a double-layer structure is adopted to arrange a common supply path and a common discharge path to overlap with each other in an up-down direction.

In this context, in the ink jet recording apparatus as described above, when the ink is circulated, some air bubbles may come into the supply manifold. If the air bubbles flowing in the supply manifold intrude into the pressure chambers, then the jet characteristic of the ink from the nozzles is liable to vary when the recording head is driven. Therefore, it is desired to adopt a flow channel structure where the air bubbles having come into the supply manifold are less likely to intrude into the pressure chambers. Further, in case the air bubbles have once come into the pressure chambers, it is desired to discharge the air bubbles immediately to the feedback manifold. Hence, it is desired to adopt a flow channel structure where the air bubbles having intruded into the pressure chambers are easily discharged to the feedback manifold.

An object of the present disclosure is to provide a liquid discharge head having a flow channel structure where a liquid is circulated, and air bubbles flowing in a supply manifold are less likely to intrude into pressure chambers and, in the flow channel structure, the air bubbles having intruded into the pressure chambers are easily discharged to a feedback manifold. Another object of the present disclosure is to provide a liquid discharge apparatus including the above liquid discharge head.

SUMMARY

According to an aspect of the present disclosure, there is provided a liquid discharge head including: a supply manifold extending in a first direction; a feedback manifold extending in the first direction; and a plurality of individual flow channels having a plurality of pressure chambers and a plurality of nozzles. Each of the individual flow channels includes: a supply portion connecting the supply manifold and one of the plurality of pressure chambers, a descender portion extending in a second direction orthogonal to the first direction and connecting the one of the plurality of pressure chambers and one of the plurality of nozzles, and a feedback portion branching from the descender portion and connected to the feedback manifold. The supply manifold has a plurality of supply ports connected to the supply portions of the plurality of individual flow channels, and the feedback manifold has a plurality of feedback ports connected to the feedback portions of the plurality of individual flow channels. A distance, in a third direction orthogonal to the first direction and to the second direction, between the center of the supply manifold in the third direction and the plurality of supply ports of the supply manifold is longer than ¼ of the width of the supply manifold in the third direction, and a distance in the third direction between the center of the feedback manifold in the third direction and the plurality of feedback ports of the feedback manifold is shorter than ¼ of the width of the feedback manifold in the third direction.

The flow speed of the liquid flowing in a center portion of the supply manifold in the third direction is faster than the flow speed of the liquid flowing in the vicinity of the end of the supply manifold in the third direction. Likewise, the flow speed of the liquid flowing in the vicinity of the center of the feedback manifold in the third direction is faster than the flow speed of the liquid flowing in the vicinity of the end of the feedback manifold in the third direction. Suppose that in the supply manifold, the number of air bubbles is uniform per unit volume. Then, the number of air bubbles passing through is larger in an area where the flow speed is fast than in an area where the flow speed is slow per unit time. Further, usually, a feeding port is more often arranged in an approximately central portion of the supply manifold in the third direction to feed the liquid to the supply manifold. In this case, it is conceivable that air bubbles flow in from the feeding port arranged in the approximately central portion of the supply manifold in the third direction. Therefore, the number of air bubbles (the number of air bubbles passing through per unit time) is even larger when flowing in the vicinity of the center of the feedback manifold in the third direction than when flowing in the vicinity of the end of the supply manifold in the third direction. From such reason, the number of air bubbles is larger when passing through the center portion of the supply manifold in the third direction per unit time than when passing through the vicinity of the end of the supply manifold in the third direction per unit time where the flow speed is slower than in the central portion. Hence, by letting the supply ports of the supply manifold be closer to the end of the supply manifold in the third direction than to the central portion of the supply manifold in the third direction, the air bubbles flowing in the supply manifold are prevented from intruding into the individual flow channels through the supply ports. Further, the feedback ports of the feedback manifold are arranged closer to the center of the feedback manifold in the third direction than to the end of the feedback manifold in the third direction. By virtue of this, it is possible to bring the air bubbles discharged from the feedback ports of the individual flow channels onto the fast flow in the vicinity of the center of the feedback manifold in the third direction, thereby easily discharging the same from the individual flow channels.

DESCRIPTION OF THE EMBODIMENT

<Overall Configuration of a Printer>

Figure 1:
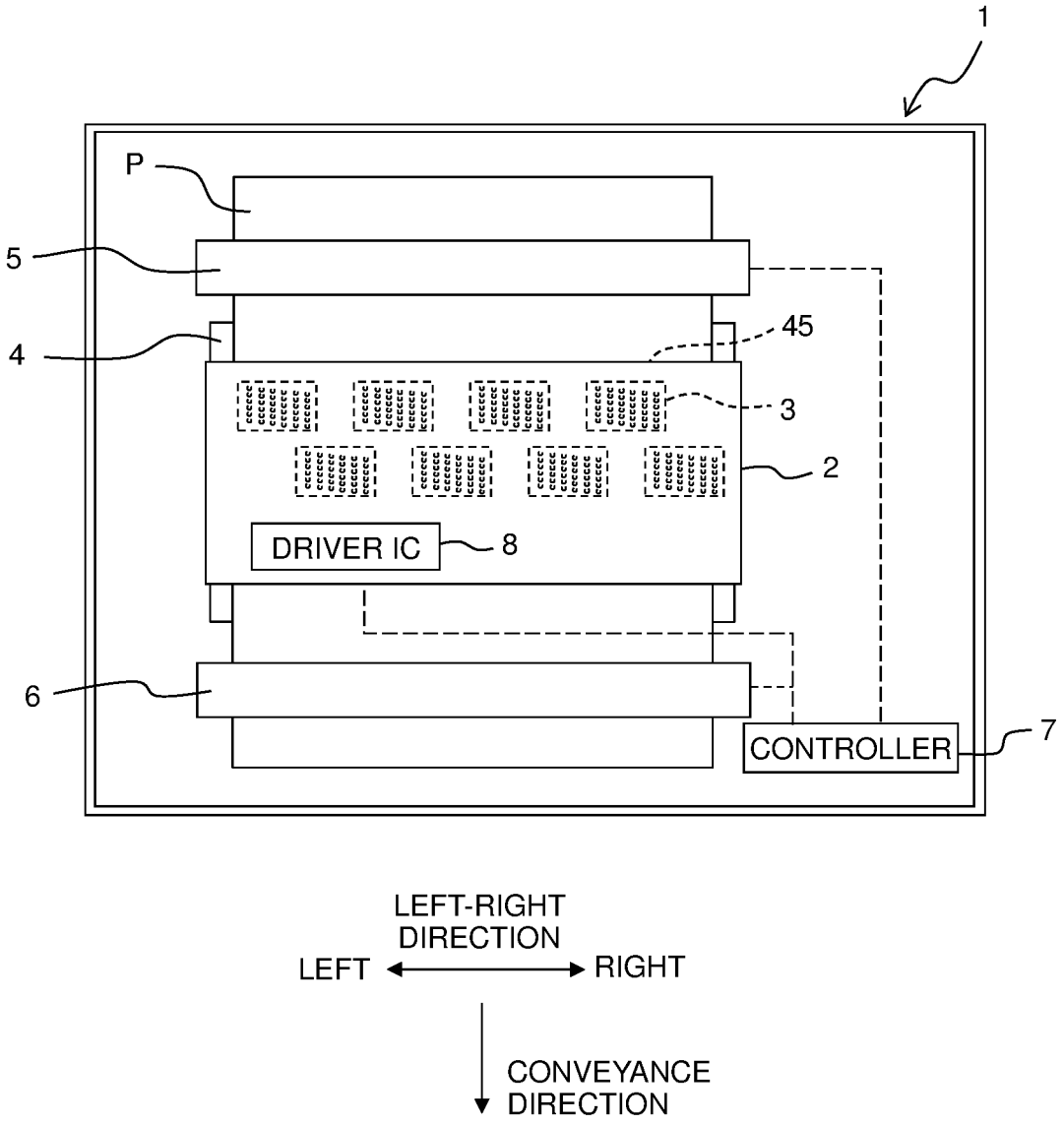
FIG. 1 is a plan view showing an outline of an ink jet printer 1 according to an embodiment of the present disclosure.

As depicted in FIG. 1, an ink jet printer 1 according to an embodiment of the present disclosure primarily includes an ink jet head 2, a platen 4, conveyance rollers 5 and 6, and a controller 7.

Note that hereinbelow, as depicted in FIG. 1, the direction of conveying recording paper P is defined as a conveyance direction. A direction orthogonal to the conveyance direction (a width direction of the recording paper P) is defined as a left-right direction. The conveyance direction is an example of the first direction of the present disclosure, while the left-right direction is an example of the third direction of the present disclosure.

The ink jet head 2 is a so-called line-type ink jet head, having eight head units 3. As depicted in FIG. 1, the eight head units 3 are arranged zigzag in the conveyance direction and in the left-right direction. Each of the head units 3 is provided to jet an ink from a plurality of nozzles 45 formed in the lower surface thereof. A driver IC 8 is provided on the ink jet head 2. As will be described later on, with the controller 7 controlling the driver IC 8, the ink is jetted from the expected nozzles 45.

The platen 4 is arranged to face the lower surface of the ink jet head 2. The platen 4 extends across the entire length of the recording paper P in the left-right direction. The platen 4 supports the recording paper P from below. The conveyance rollers 5 and 6 are arranged at the upstream side and the downstream side of the ink jet head 2 in the conveyance direction, respectively, to convey the recording paper P in the conveyance direction.

In the ink jet printer 1, the controller 7 controls an unsown motor provided for the conveyance rollers 5 and 6 to cause the conveyance rollers 5 and 6 to convey the recording paper P through a predetermined distance in the conveyance direction. Each time the recording paper P is conveyed, the controller 7 causes the ink to be jetted from the plurality of nozzles 45 of the ink jet head 2. By virtue of this, the ink jet printer 1 carries out printing on the recording paper P.

<The Head Units 3>

Figure 2:
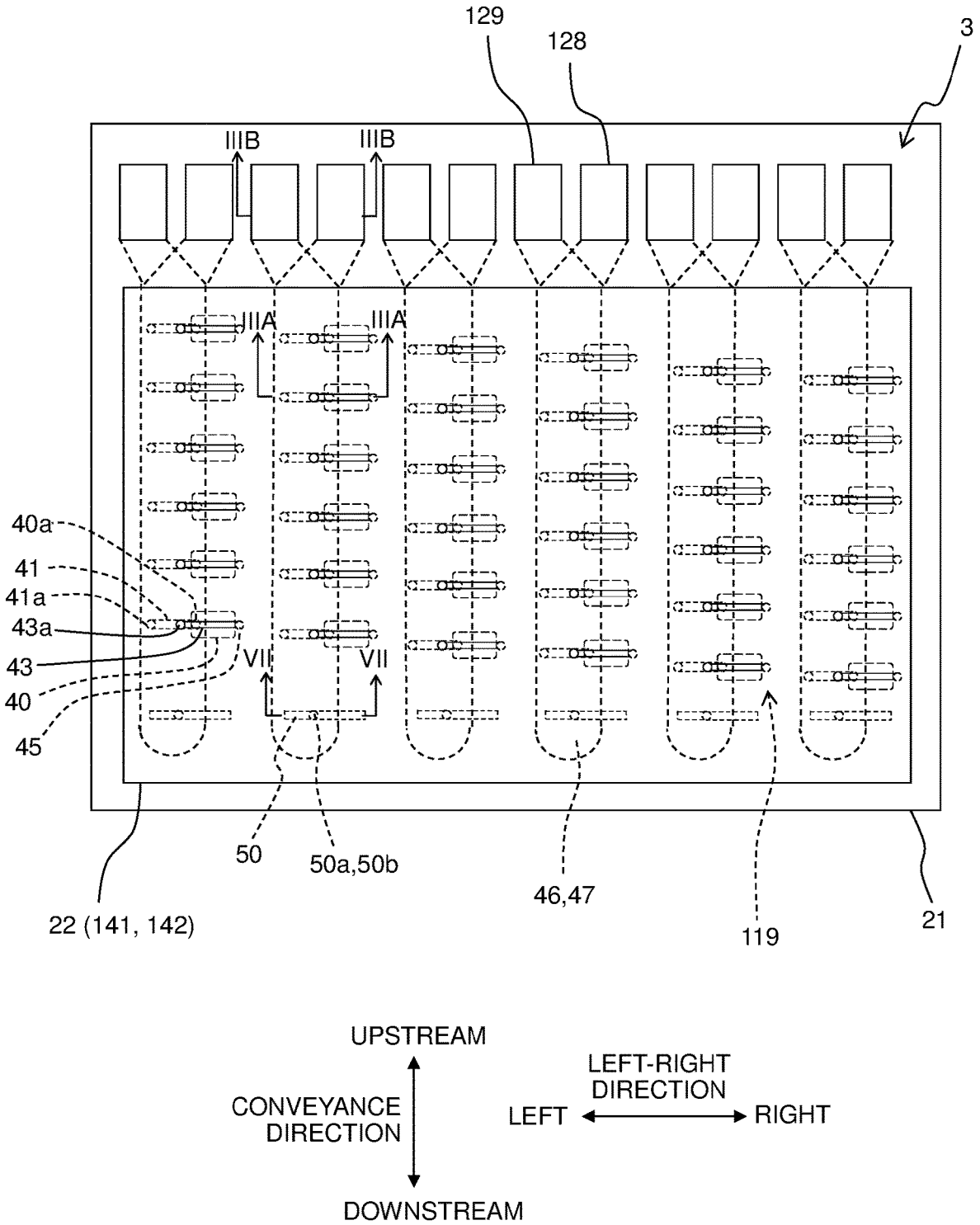
FIG. 2 is a plan view of an ink jet head according to the embodiment.
Figure 3A:
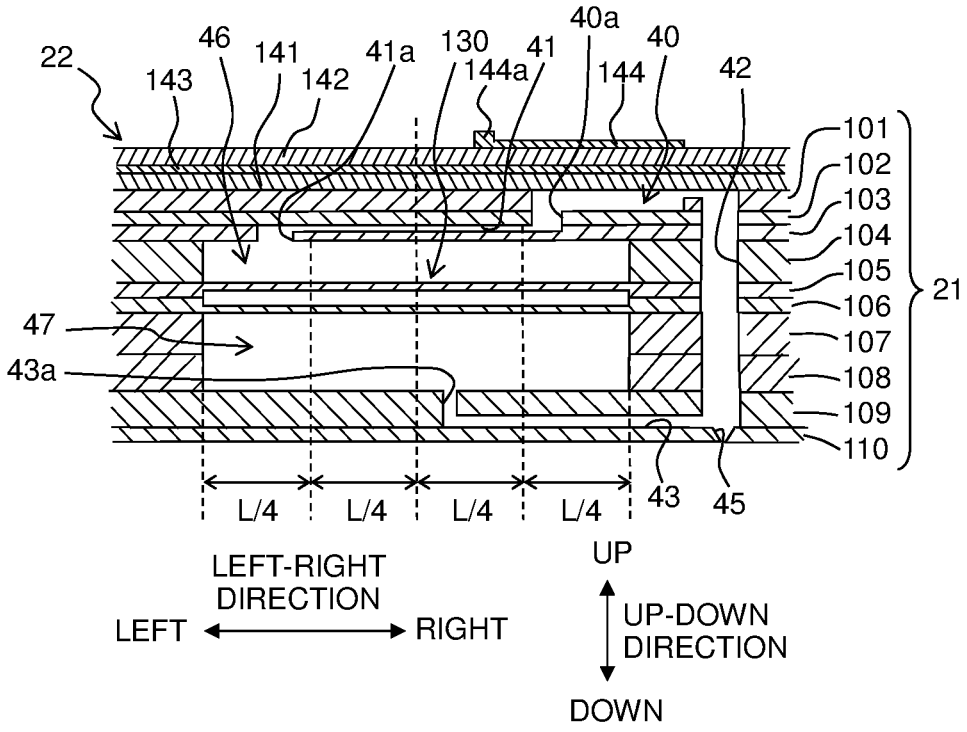
FIG. 3A is a cross section view along the line IIIA-IIIA of FIG. 2.

Next, an explanation will be made on the head units 3 of the ink jet head 2. As depicted in FIGS. 2 and 3A, each of the head units 3 includes a flow channel unit 21 where ink flow channels such as nozzles 45, pressure chambers 40 and the like are formed, and a piezoelectric actuator 22 for applying a pressure to the ink in the pressure chambers 40.

<The Flow Channel Unit 21>

Figure 3B:
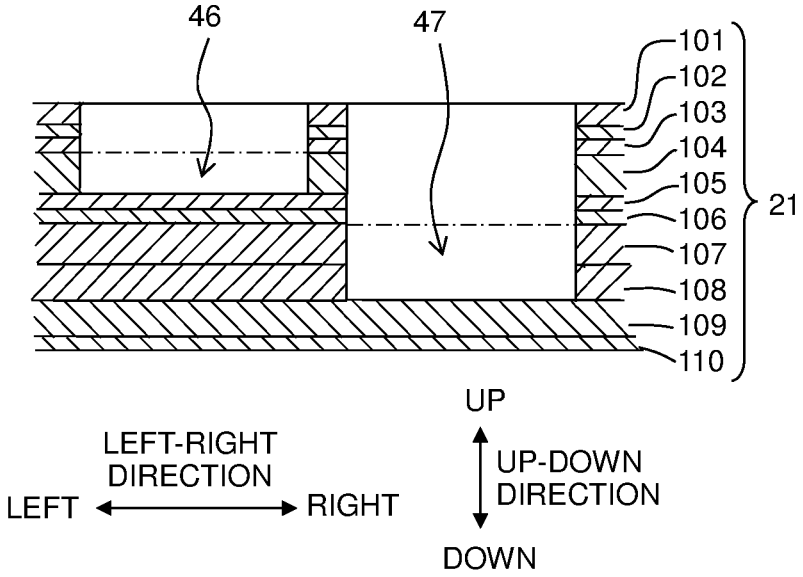
FIG. 3B is a cross section view along the line IIIB-IIIB of FIG. 2.

As depicted in FIGS. 3A and 3B, the flow channel unit 21 has ten plates 101 to 110 formed in layers along an up-down direction. The up-down direction corresponds to the second direction of the present disclosure. As depicted in FIG. 2, the flow channel unit 21 has six supply manifolds 46, six feedback manifolds 47, a plurality of individual flow channels 30, and a plurality of pressure chambers 40 and a plurality of nozzles 45 formed in the plurality of individual flow channels 30. Each of the plurality of individual flow channels 30 has a supply portion 41, a descender portion 42 (see FIG. 3A), and a feedback portion 43. Note that in order to view the figure easily, FIG. 2 shows the feedback portions 43 with solid lines.

The plurality of pressure chambers 40 are formed in the plate 101. Each pressure chamber 40 has an approximately rectangular shape with the left-right direction as its lengthwise direction. Further, the plurality of pressure chambers 40 form six pressure chamber arrays 119 aligning in the left-right direction. Each pressure chamber array 119 extends in the conveyance direction. Between two adjacent pressure chamber arrays 119, the pressure chambers 40 deviate in position in the conveyance direction.

The plurality of supply portions 41 are formed through the plates 102 and 103. Each supply portion 41 is a flow channel linking one pressure chamber 40 to a supply manifold 46. One end of each supply portion 41 is connected to a pressure chamber 40 via an opening 40*a* formed at the left end of the pressure chamber 40. The other end of each supply portion 41 is connected to the supply manifold 46 via a supply port 41*a* (an example of the supply port of the present disclosure). The supply portion 41 is smaller in cross-sectional area than the descender portion 42. The supply portion 41 is connected with the left end of the pressure chamber 40, and extends leftward from the connection part with the pressure chamber 40.

The plurality of descender portions 42 are formed of through holes which are overlapped in the up-down direction and formed in the plates 102 and 109. Each descender portion 42 is a flow channel connecting one pressure chamber 40 to a nozzle 45, and extends downward from the right end of the pressure chamber 40. The nozzle 45 is arranged in the lower end of the descender portion 42.

The plurality of feedback portions 43 are formed through the plate 109. Each feedback portion 43 is a flow channel linking one descender portion 42 to a feedback manifold 47. The feedback portion 43 extends leftward from the connection part with the descender portion 42 formed in the plate 109. Further, the feedback portion 43 is connected to the feedback manifold 47 via a feedback port 43*a* (an example of the feedback port of the present disclosure) formed in the plate 109. Note that the feedback port 43*a* is larger in opening area than the supply port 41*a*.

The plurality of nozzles 45 are formed in the plate 110. Each nozzle 45 is arranged in the lower end of one descender portion 42. One individual flow channel 30 is formed from a nozzle 45, a descender portion 42 connected to the nozzle 45, a feedback portion 43 and a pressure chamber 40 connected to the descender portion 42, and a supply portion 41 connected to the pressure chamber 40.

As depicted in FIG. 3A, the supply manifold 46 is formed in the plate 104. As depicted in FIG. 2, the six supply manifolds 46 extend in the conveyance direction and align at intervals in the left-right direction, respectively. The six supply manifolds 46 correspond to the six pressure chamber arrays 119, and each supply manifold 46 is connected with the plurality of pressure chambers 40 forming the corresponding pressure chamber array 119, via the supply portions 41. A feeding port 128 is provided at the upstream end of each supply manifold 46 in the conveyance direction. Then, the ink retained in the undepicted ink tank is fed from the feeding port 128 to the supply manifold 46. By virtue of this, in each supply manifold 46, the ink flows from the upstream side toward the downstream side in the conveyance direction, such that the ink passes through each supply portion 41 and is then supplied to each pressure chamber 40.

As depicted in FIG. 3A, the feedback manifold 47 is formed in the plates 107 and 108. As depicted in FIG. 2, the six feedback manifolds 47 extend in the conveyance direction and align at intervals in the left-right direction, respectively. A retrieving port 129 is provided in at the upstream end of each feedback manifold 47 in the conveyance direction. The retrieving ports 129 are connected with the undepicted ink tank. As depicted in FIGS. 3A and 3B, the feedback manifold 47 is positioned below the supply manifold 46, overlapping with the supply manifold 46 in the up-down direction. Further, the six feedback manifolds 47 correspond to the six pressure chamber arrays 119, and each feedback manifold 47 is connected with the plurality of pressure chambers 40 forming the corresponding pressure chamber array 119, via the descender portion 42 and the feedback portion 43. The ink not jetted from the nozzle 45 flows into the feedback manifold 47 from the feedback portion 43 of each individual flow channel 30, flows on from the downstream side to the upstream side in the conveyance direction, and is finally retrieved from the retrieving port 129. The ink flowing out of the retrieving ports 129 is returned to the undepicted ink tank.

Figure 7:
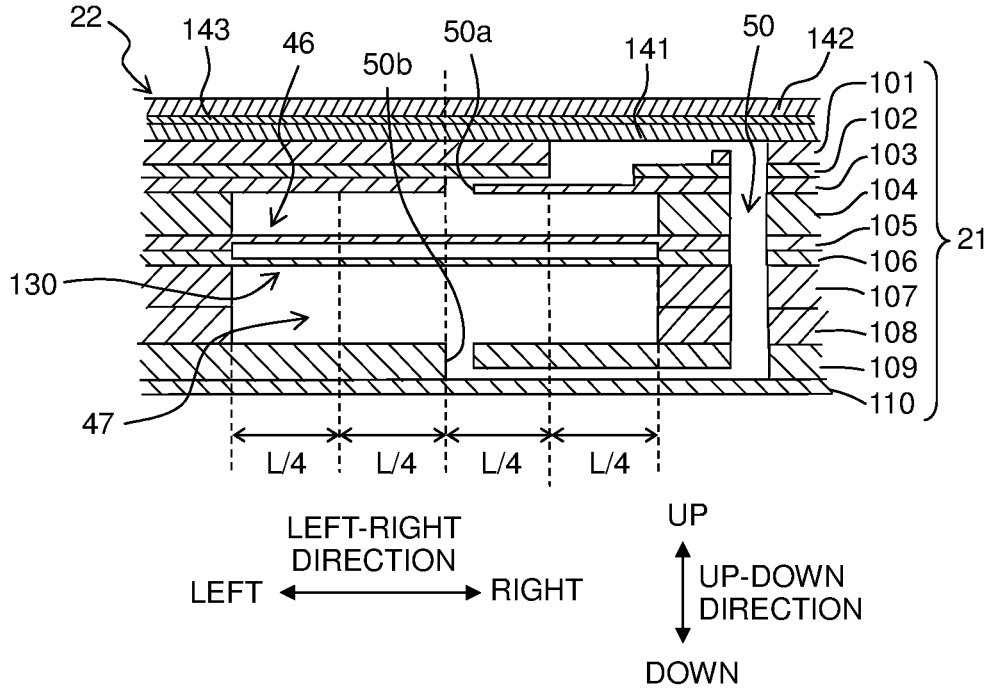
FIG. 7 is a cross section view along the line VII-VII of FIG. 2.

Further, as depicted in FIG. 2, at the downstream end of the supply manifolds 46 and the feedback manifolds 47 in the conveyance direction, communication flow channels 50 are formed to link the supply manifolds 46 and the feedback manifolds 47. As depicted in FIG. 7, except for the aspect of being not in communication with the nozzle 45, the communication flow channel 50 has the same shape as the individual flow channel 30. Further, a communication port 50*a*, which is a connection port of the communication flow channel 50 and the supply manifold 46, is arranged at almost the center of the supply manifold 46 in the left-right direction. Likewise, a communication port 50*b*, which is a connection port of the communication flow channel 50 and the feedback manifold 47, is arranged at almost the center of the feedback manifold 47 in the left-right direction.

In this embodiment, an undepicted pump is provided in midstream of the flow channel between the feeding port 128 and the ink tank, or provided in midstream of the flow channel between the retrieving port 129 and the ink tank. Due to the ink flow caused by the undepicted pump being driven, the ink circulates between the ink jet head 2 and the undepicted ink tank. Note that, in this embodiment, the pressure on the ink flowing in the supply manifold 46 is rendered larger than the pressure on the ink flowing in the feedback manifold 47.

Further, in the flow channel unit 21, a damper 130 is formed to extend into the lower part of the plate 105 and into the upper part of the plate 106, and to overlap with the supply manifold 46 and the feedback manifold 47 in the up-down direction. Then, by deforming a partition wall formed by a lower end portion of the plate 106 to separate the supply manifold 46 from the damper 130, the ink inside the supply manifold 46 is restrained from pressure variation. Further, by deforming a partition wall formed by an upper end portion of the plate 105 to separate the feedback manifold 47 from the damper 130, the ink inside the feedback manifold 47 is restrained from pressure variation.

<Piezoelectric Actuator>

As depicted in FIG. 3A, the piezoelectric actuator 22 has two piezoelectric layers 141 and 142, a common electrode 143, and a plurality of individual electrodes 144. The piezoelectric layers 141 and 142 are formed of a piezoelectric material. For example, it is possible to use a piezoelectric material whose primary component is lead zirconate titanate or piezoelectric zirconate titanate (PZT) which is a mixed crystal of lead zirconate and lead titanate. The piezoelectric layer 141 is arranged on the upper surface of the flow channel unit 21, while the piezoelectric layer 142 is arranged on the upper surface of the piezoelectric layer 141. Note that the piezoelectric layer 141 may be formed of an insulating material other than a piezoelectric material.

The common electrode 143 is arranged between the piezoelectric layer 141 and the piezoelectric layer 142 to extend continuously through the entire area of the piezoelectric layers 141 and 142. The common electrode 143 is maintained at the ground potential. The plurality of individual electrodes 144 are provided individually for the plurality of pressure chambers 40. The individual electrodes 144 each have an approximately rectangular planar shape and are arranged to overlap with a central portion of the corresponding pressure chamber 40 in the up-down direction. Connection terminals 144*a* of the plurality of individual electrodes 144 are connected to the driver IC 8 (see FIG. 1) via undepicted wire members. Then, the driver IC 8 applies such a potential individually to the plurality of individual electrodes 144 as selectable between the ground potential and a drive potential. Further, corresponding to such an arrangement of the common electrode 143 and the plurality of individual electrodes 144, such active portions are formed between the common electrode 143 and the individual electrodes 144 of the piezoelectric layer 142, respectively, as polarized in a thickness direction.

Hereinafter, an explanation will be made on a method for driving the piezoelectric actuator 22 to jet the ink from the nozzles 45. In this embodiment, as will be explained below, the ink is jetted by way of so-called "retreat shooting". The following control is carried out by the controller 7 (see FIG. 1) controlling the driver IC 8 to control the potentials of the common electrode 143 and the individual electrodes 144. In the piezoelectric actuator 22, in a standby state where the ink is not jetted from the nozzles 45, the common electrodes 143 are kept at the same ground potential while all individual electrodes 144 are kept at the drive potential different from the ground potential. On this occasion, the parts of the piezoelectric layers 141 and 142 overlapping with the pressure chambers 40 in the up-down direction deform as a whole to project toward the pressure chambers 40.

In order to jet the ink from a certain nozzle 45, the potential of the individual electrode 144 corresponding to that nozzle 45 is switched to the ground potential. By virtue of this, the parts of the piezoelectric layers 141 and 142 overlapping with the pressure chamber 40 in the up-down direction are recovered from the deformation such that the pressure chamber 40 increases in volume. Thereafter, by switching the potential of the individual electrode 144 back to the drive potential, the parts of the piezoelectric layers 141 and 142 overlapping with the pressure chamber 40 in the up-down direction deform again to project toward the pressure chamber 40. By virtue of this, the pressure of the ink in the pressure chamber 40 increases so as to be jetted from the nozzle 45 in communication with the pressure chamber 40. After the ink is jetted from the nozzle 45, the individual electrode 144 is still kept at the drive potential.

<Functions and Effects of This Embodiment>

In the ink jet head 2 as explained in the above, air bubbles may be mixed into the ink supplied to the supply manifolds 46 from the ink tank. The ink mixed with the air bubbles flows on the ink flow course in the supply manifolds 46, but some of the air bubbles may flow into the supply portions 41 from the supply manifolds 46. If the air bubbles having flowed into the supply portions 41 flow into the pressure chambers 40 and the descender portions 42, then the ink from the nozzles 45 is liable to vary in jet characteristic.

The flow speed of the ink is not completely uniform in the supply manifolds 46 of this embodiment. For example, the flow speed of the ink flowing in the vicinity of the center of the supply manifold 46 in the left-right direction is faster than the flow speed of the ink flowing in the vicinity of the two opposite ends of the supply manifold 46 in the left-right direction. This is because when the ink flows near the wall surface, due to the friction against the wall surface, the flow resistance becomes large. Suppose that in the supply manifold 46, the number of air bubbles is uniform per unit volume. Then, the number of air bubbles passing through is larger in an area where the flow speed is fast than in an area where the flow speed is slow per unit time. Therefore, in the supply manifold 46, there is a high possibility that the number of air bubbles passing through is larger in the vicinity of the center in the left-right direction where the flow speed is fast than in the vicinity of the two opposite ends in the left-right direction where the flow speed is slow per unit time. In this embodiment, therefore, the supply port 41*a*, which is the connection port between the supply manifold 46 and the supply portion 41, is arranged near the end of the supply manifold 46 in the left-right direction. In particular, as depicted in FIG. 3A, in the supply manifold 46 divided equally into four areas, the supply port 41*a* is arranged in the leftmost area. In other words, if L refers to the width of the supply manifold 46 in the left-right direction, then the distance from the left end of the supply manifold 46 to the supply port 41*a* in the left-right direction is shorter than L/4, whereas the distance from the center of the supply manifold 46 to the supply port 41*a* in the left-right direction is longer than L/4. Note that in the above definition of distance, the position of the supply port 41*a* refers to the central position of the supply port 41*a*. The central position of the supply port 41*a* may adopt the barycentric position of the supply port 41*a*, for example, or can adopt the center of the inscribed circle of the supply port 41*a*. Further, it is possible to measure the width of the supply manifold 46 in the left-right direction at the part of the farthest end in the left-right direction. For example, if the lateral surface of the supply manifold 46 in the left-right direction is not in a planar shape as depicted in FIG. 3A but in a curved shape inflated outward in the left-right direction, then it is possible to measure the width of the supply manifold 46 in the left-right direction at such a part in the end as positioned outermost in the left-right direction (the part inflated outermost in the left-right direction). Note that in this embodiment, L is 1 to 2 mm.

In this embodiment, the supply port 41*a*, which is the connection port between the supply manifold 46 and the supply portion 41, is arranged far away from the center of the supply manifold 46 in the left-right direction, and near the end of the supply manifold 46 in the left-right direction. Therefore, it is possible to reduce the possibility that the air bubbles flowing in the supply manifold 46 flow into the supply port 41*a*.

Likewise, the flow speed of the ink is not completely uniform, too, in the feedback manifolds 47. The flow speed of the ink flowing in the vicinity of the center of the feedback manifold 47 in the left-right direction is faster than the flow speed of the ink flowing in the vicinity of the two opposite ends of the feedback manifold 47 in the left-right direction. Hence, it is desirable to discharge the air bubbles having flowed into the supply portion 41 through the supply port 41*a*, immediately to the feedback manifold 47 through the feedback portion 43. In this embodiment, therefore, the feedback port 43*a*, which is the connection port between the feedback manifold 47 and the feedback portion 43, is arranged near the center of the feedback manifold 47 in the left-right direction. In particular, as depicted in FIG. 3A, in the feedback manifold 47 divided equally into four areas, the feedback port 43*a* is arranged in the second area from the right. In other words, if L refers to the width of the feedback manifold 47 in the left-right direction, then the distance from the right end of the feedback manifold 47 to the feedback port 43*a* in the left-right direction is longer than L/4, whereas the distance from the center of the feedback manifold 47 to the feedback port 43*a* in the left-right direction is shorter than L/4. In the same manner as explained earlier on, in the above definition of distance, the position of the feedback port 43*a* refers to the central position of the feedback port 43*a* (for example, the barycentric position, the central position of the inscribed circle, and the like). Further, it is supposed to measure the width of the feedback manifold 47 in the left-right direction at the part of the farthest end in the left-right direction.

In this embodiment, the feedback port 43*a*, which is the connection port between the feedback manifold 47 and the feedback portion 43, is arranged far away from the end of the feedback manifold 47 in the left-right direction, and near the center of the feedback manifold 47 in the left-right direction. By virtue of this, it is possible to bring the air bubbles discharged from the feedback port 43*a* onto the fast flow in the vicinity of the center of the feedback manifold 47 in the left-right direction, thereby reliably discharging the same from the feedback port 43*a*.

As described above, in the communication flow channel 50 arranged at the downstream end of the supply manifold 46 and the feedback manifold 47 in the conveyance direction, the communication port 50*a* is arranged at almost the center of the supply manifold 46 in the left-right direction, while the communication port 50*b* is arranged at almost the center of the feedback manifold 47 in the left-right direction. Because the communication port 50*a* is arranged at almost the center of the supply manifold 46 in the left-right direction, it is possible to guide, to the communication port 50*a* reliably, the air bubbles flowing in on the fast flow in the vicinity of the center of the supply manifold 46 in the left-right direction. In addition, because the communication port 50*b* is arranged at almost the center of the feedback manifold 47 in the left-right direction, it is possible to bring the air bubbles having flowed from the communication port 50*a* to the communication flow channel 50 onto the fast flow in the vicinity of the center of the feedback manifold 47 in the left-right direction, thereby reliably discharging the same from the communication port 50*b*. By virtue of this, it is possible to discharge the air bubbles flowing in the supply manifold 46 to the feedback manifold 47 and finally return the same to the undepicted ink tank.

In this embodiment, the opening area of the supply port 41*a* of the supply portion 41 is larger than the opening area of the feedback port 43*a* of the feedback portion 43. By virtue of this, air bubbles are less likely to intrude from the supply port 41*a* and, from the feedback port 43*a*, the air bubbles are easily discharged.

Further, the supply manifold 46 is lower in height than the feedback manifold 47 in the up-down direction (in the layered direction). Therefore, compared to the case where the supply manifold 46 and the feedback manifold 47 are formed to conform in height in the up-down direction, it is possible to increase the ratio of the length in the left-right direction to the length in the up-down direction of the cross-sectional shape of the supply manifold 46 depicted in FIG. 3A (to be referred to simply as "aspect ratio" below). By virtue of this, compared to the case where the supply manifold 46 and the feedback manifold 47 are formed to conform in height in the up-down direction, it is possible to increase the difference between the flow speed of the ink flowing in the central portion of the supply manifold 46 in the left-right direction and the flow speed of the ink flowing in the vicinity of the end thereof in the left-right direction. By virtue of this, it is possible to gather the air bubbles flowing in the supply manifold 46 into the fast flow in the vicinity of the center in the left-right direction. Therefore, it is possible to reduce the possibility that the air bubbles flowing in the supply manifold 46 may flow into the supply port 41*a* arranged near the end of the supply manifold 46 in the left-right direction.

In this embodiment, the center of the supply manifold 46 in the left-right direction is positioned between the supply port 41*a* and the descender portion 42 in the left-right direction. In other words, the supply port 41*a* and the descender portion 42 are arranged on the opposite side to each other with respect to the center of the supply manifold 46 in the left-right direction. Along with that, the supply portion 41 linking the pressure chamber 40 and the supply manifold 46 extends straightly in the left-right direction. Because the ink flows also straightly in the supply portion 41, even if air bubbles flow into the supply port 41*a*, it is still possible to cause the same to pass through the supply portion 41 immediately.

In this embodiment, the center of the supply manifold 46 in the left-right direction is positioned between the supply port 41*a* and the feedback port 43*a* in the left-right direction. In other words, the supply port 41*a* and the feedback port 43*a* are arranged on the opposite side to each other with respect to the center of the supply manifold 46 in the left-right direction. Therefore, the supply port 41*a* and the feedback port 43*a* are positioned to deviate in the left-right direction, and do not overlap in the up-down direction. The pressure wave arising from the ink flow toward the supply port 41*a* and the pressure wave arising from the ink flow discharged from the feedback port 43*a* both propagate radially to arrive at the damper 130. On this occasion, the pressure wave arising from the ink flow toward the supply port 41*a* first arrives at a position of the damper 130 overlapping with the supply port 41*a* in the up-down direction. Further, the pressure wave arising from the ink flow discharged from the feedback port 43 a first arrives at a position of the damper 130 overlapping with the feedback port 43*a* in the up-down direction. In this embodiment, the supply port 41*a* and the feedback port 43*a* deviate in position in the left-right direction, and do not overlap in the up-down direction. Therefore, the part of the damper 130 at which the pressure wave arising from the ink flow toward the supply port 41*a* first arrives deviates in position in the left-right direction from the part of the damper 130 at which the pressure wave arising from the ink flow discharged from the feedback port 43*a* first arrives, such that there is no interference with each other.

In this embodiment, the supply port 41*a* is located in a position to deviate a little to the center in the left-right direction from the end of the supply manifold 46 in the left-right direction but not in a position to overlap in the up-down direction with the end thereof in the left-right direction. In other words, the supply port 41*a* is positioned between the end of the supply manifold 46 in the left-right direction and the center of the supply manifold 46 in the left-right direction. The flow channels formed from the supply port 41*a*, the supply manifold 46 and the like are formed by layering the plates 101 to 110 after each of the plates 101 to 110 is etched. On this occasion, due to some manufacturing errors, those plates may deviate in position from the target positions. However, as described above, because the supply port 41*a* is located in a position to deviate a little to the center in the left-right direction from the end of the supply manifold 46 in the left-right direction, even if the plates 101 to 110 deviate in positional conformation, the supply port 41*a* is still not liable to interfere with the end of the supply manifold 46 in the left-right direction. By virtue of this, it is possible to prevent variation from arising in the flow channel resistance of the supply portion 41.

In the above embodiment, the feedback port 43*a* is positioned between the center of the feedback manifold 47 in the left-right direction and the descender portion 42 in the left-right direction. In other words, in the left-right direction, the feedback port 43*a* and the descender portion 42 are positioned at the same side with respect to the center of the feedback manifold 47 in the left-right direction. By virtue of this, in the left-right direction, it is possible to lessen the length of the feedback portion 43, compared to the case where the feedback port 43*a* and the descender portion 42 are positioned at the opposite side to each other with respect to the center of the feedback manifold 47 in the left-right direction. By virtue of this, it is possible to lower the flow channel resistance of the feedback portion 43, compared to the case where the feedback port 43*a* and the descender portion 42 are positioned at the opposite side to each other with respect to the center of the feedback manifold 47 in the left-right direction. Therefore, it is possible to effectively discharge the air bubbles having flowed into the individual flow channel 30 through the feedback portion 43.

In this embodiment, between the ink jet head 2 and the undepicted ink tank, the ink flows in circulation via the supply manifold 46 and the feedback manifold 47. Therefore, a positive pressure is applied on the ink flowing in the supply manifold 46. If the positive pressure is applied on the ink flowing in the supply manifold 46, then such a force acts on the plurality of plates forming the flow channel unit 21 as to detach the adhesions between the plates (to be referred to simply as detachment force below). Then, in some cases, the flow channel unit 21 is liable to damage.

In this embodiment, the supply manifold 46 and the feedback manifold 47 adopt a double-layer structure to overlap in the up-down direction. By virtue of this, it is possible to make a compact ink jet head 2. Further, because the feedback manifold 47 is positioned below the supply manifold 46, it is possible to raise the rigidity of the flow channel unit 21 below the supply manifold 46 with the plates 106 to 109 forming the feedback manifold 47. By virtue of this, compared to the case where the feedback manifold 47 is not arranged below the supply manifold 46, it is possible to suppress such a detachment force toward the downside of the supply manifold 46 as arising from the pressure of the ink flowing in the supply manifold 46. In this embodiment, especially, the depth of the feedback manifold 47 (the length in the up-down direction) is larger than the depth of the supply manifold 46, and the number of plates constituting the feedback manifold 47 is larger than the number of plates constituting the supply manifold 46. Therefore, compared to the case where the number of plates constituting the feedback manifold 47 is smaller than the number of plates constituting the supply manifold 46, it is possible to greatly raise the rigidity of the lower part of the flow channel unit 21 below the supply manifold 46.

Further, in this embodiment, the piezoelectric layers 141 and 142 are not segmented to cover one pressure chamber 40 but spread over the entire area where the flow channels of the flow channel unit 21 are formed, so as to cover all pressure chambers 40 (see FIG. 2). By virtue of this, it is possible to raise the rigidity of the upper part of the flow channel unit 21 above the supply manifold 46. It is possible to suppress such a detachment force toward the upside of the supply manifold 46 as arising from the pressure of the ink flowing in the supply manifold 46.

In the above embodiment, as described earlier on, the pressure on the ink flowing in the supply manifold 46 is rendered larger than the pressure on the ink flowing in the feedback manifold 47. By virtue of this, because it is possible to raise the flow speed of the ink flowing in the supply manifold 46, it is possible to lessen the air bubbles flowing into the supply portion 41. However, if the pressure on the ink flowing in the supply manifold 46 is large, then there is also a large detachment force arising from the pressure of the ink flowing in the supply manifold 46. In the above embodiment, however, as described earlier on, because the piezoelectric layers 141 and 142 spread to cover all pressure chambers 40, it is possible to raise the rigidity of the flow channel unit 21 in the part above the supply manifold 46. Therefore, even if there is a large detachment force arising upward in the supply manifold 46, from the pressure of the ink flowing in the supply manifold 46, it is still possible to suppress the same.

In the above embodiment, the individual electrodes 144 cover right end portions of the supply manifolds 46 from above. By virtue of this, it is possible to raise the rigidity of the upper part of the flow channel unit 21 in the end portions of the supply manifold 46, and thus it is possible to suppress the detachment force arising upward in the supply manifold 46, from the pressure of the ink flowing in the supply manifold 46. Further, in this embodiment, because the retreat shooting method is adopted as described earlier on, when no ink is jetted, the individual electrodes 144 are still constantly kept at the drive potential. Therefore, when no ink is jetted, a voltage is still applied to the parts of the piezoelectric layers 141 and 142 overlapping with the pressure chambers 40 in the up-down direction, such that the parts of the piezoelectric layers 141 and 142 overlapping with the pressure chambers 40 in the up-down direction deform as a whole to project toward the pressure chambers 40. While the voltage is applied, the piezoelectric layers 141 and 142 are to maintain the deformed state, such that the rigidity of the piezoelectric layers 141 and 142 is higher than that when the voltage is not applied. By virtue of this, it is possible to raise the rigidity of the upper part of the flow channel unit 21 above the supply manifold 46, and thus it is possible to suppress the detachment force arising upward in the supply manifold 46, from the pressure of the ink flowing in the supply manifold 46.

Modified Embodiments

Figure 4:
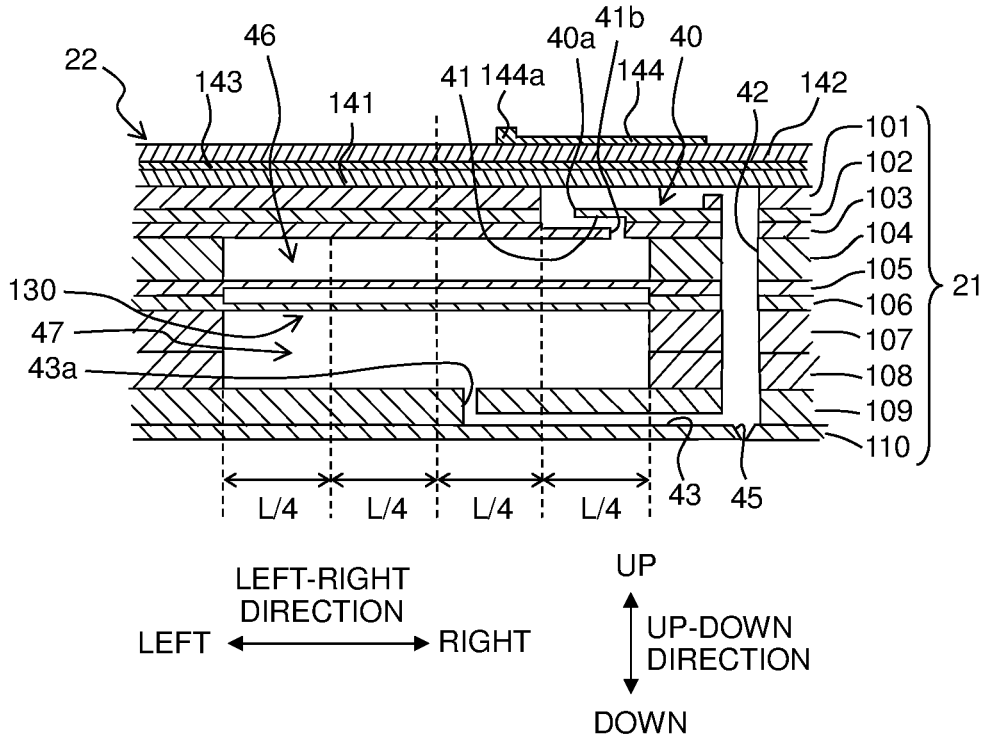
FIG. 4 shows an ink jet head according to a modified embodiment, corresponding to FIG. 3A.

In the above embodiment, the supply port 41*a* and the descender portion 42 are arranged on the opposite side to each other with respect to the center of the supply manifold 46 in the left-right direction. However, the present disclosure is not limited to such an aspect. As depicted in FIG. 4, for example, the supply port 41*a* and the descender portion 42 may be arranged on the same side with respect to the center of the supply manifold 46 in the left-right direction. In particular, as depicted in FIG. 4, it is possible to arrange a supply port 41*b* in the rightmost area of the four equally divided areas of the supply manifold 46 in the left-right direction. As depicted in FIG. 4, the supply manifold 46 is positioned below the supply portion 41 linking the supply port 41*b* and the pressure chamber 40, and the pressure chamber 40 is positioned thereabove. As depicted in FIG. 2, in this embodiment, the pressure chamber 40 is not arranged above the supply portion 41 but the plates 102 and 103 are arranged there. Different from that, the supply portion 41 is interposed between the supply manifold 46 and the pressure chamber 40 in the up-down direction; therefore, compared to the case as in this embodiment where a plate is superimposed above the supply portion 41, the ink inside the supply portion 41 is less likely to be deprived of heat. This is especially effective in supplying the temperature-adjusted ink to the supply manifold 46.

Figure 5:
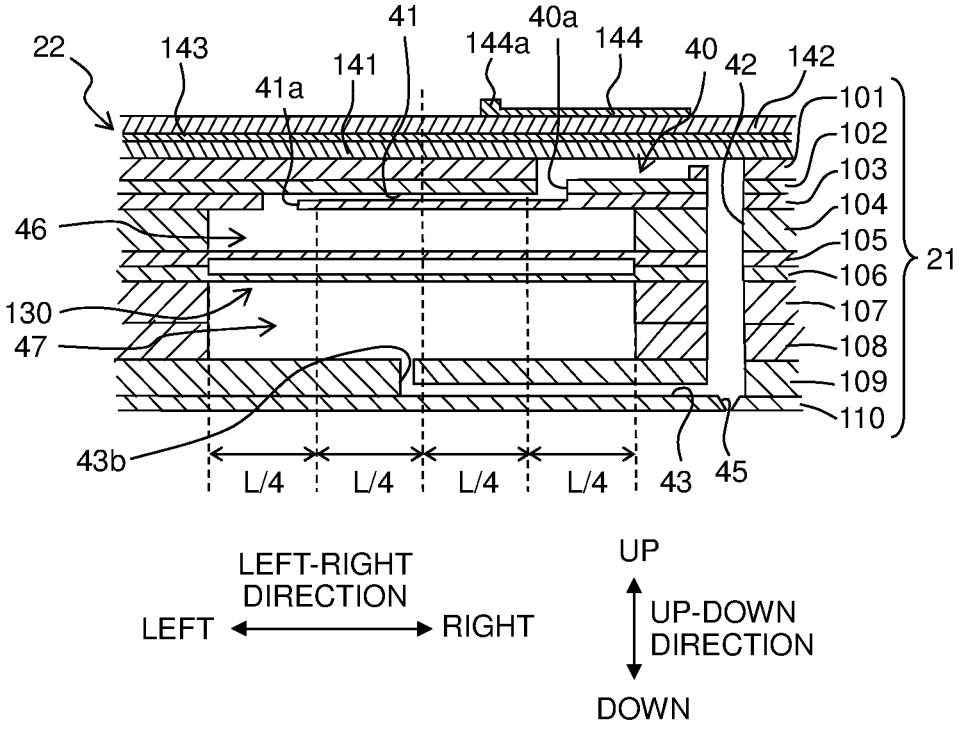
FIG. 5 shows an ink jet head according to another modified embodiment, corresponding to FIG. 3A.
Figure 6:
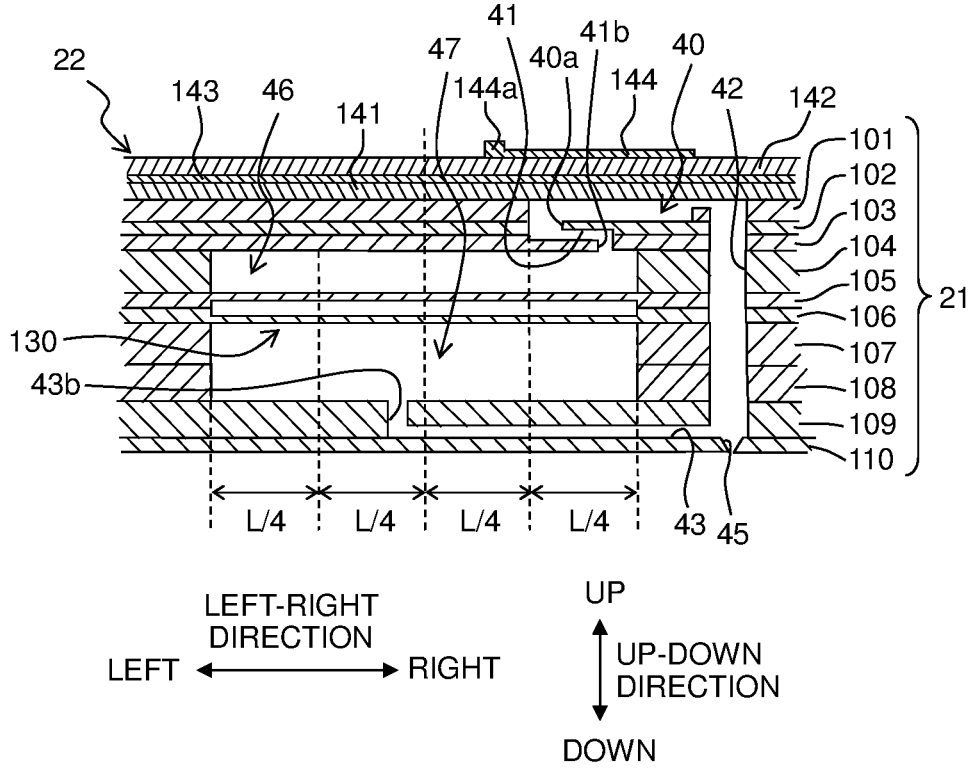
FIG. 6 shows an ink jet head according to yet another modified embodiment, corresponding to FIG. 3A.

Further, as depicted in FIGS. 5 and 6, a feedback port 43*b* and the descender portion 42 may be arranged on the opposite side to each other with respect to the center of the feedback manifold 47 in the left-right direction. In particular, as depicted in FIGS. 5 and 6, it is possible to arrange the feedback port 43*b* in the second area from the left among the four equally divided areas of the feedback manifold 47 in the left-right direction. In this case, too, because the feedback port 43*b* is arranged at almost the center of the feedback manifold 47 in the left-right direction, it is possible to bring the air bubbles onto the fast flow in the vicinity of the center of the feedback manifold 47 in the left-right direction, thereby reliably discharging the same from the feedback port 43*b*. Note that as depicted in FIG. 5, in the supply manifold 46 divided equally into four areas, the supply port 41*a* may be arranged in the leftmost area, while as depicted in FIG. 6, in the supply manifold 46 divided equally into the four areas, the supply port 41*b* may be arranged in the rightmost area. In each case, the supply ports 41*a* and 41*b* are arranged near the end of the supply manifold 46 in the left-right direction. Therefore, it is possible to reduce the possibility that the air bubbles flowing in the supply manifold 46 may flow into the supply ports 41*a* and 41*b*.

Figure 8:
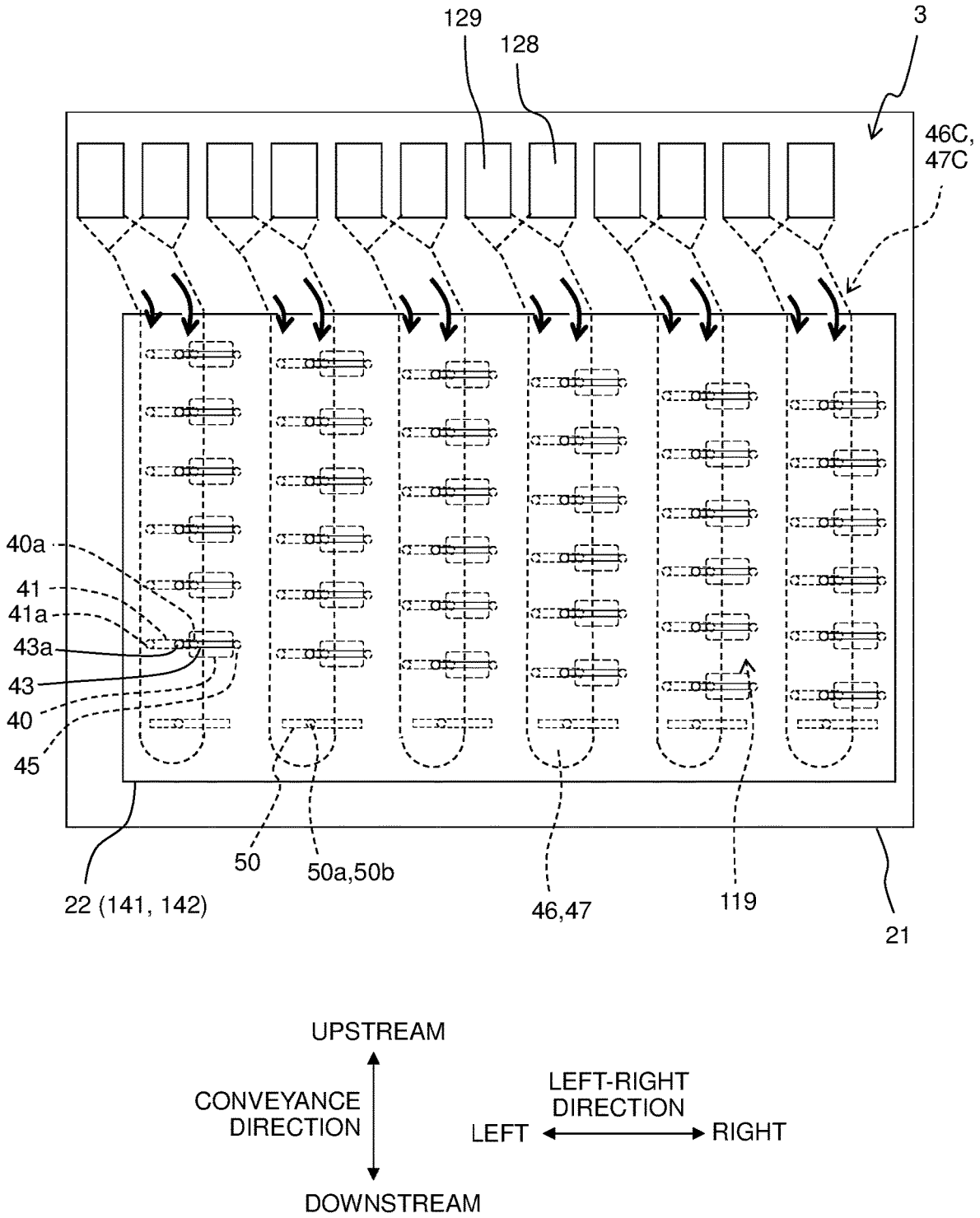
FIG. 8 shows an ink jet head according to a modified embodiment where a supply manifold and a feedback manifold have inflection portions, corresponding to FIG. 2.

Further, each of the supply manifold 46 and the feedback manifold 47 may have an inflection portion inflecting in the left-right direction. For example, as depicted in FIG. 8, the supply manifold 46 and the feedback manifold 47 may respectively have inflection portions 46C and 47C inflecting leftward at the upstream side in the conveyance direction. In the inflection portion 46C, the flow speed of the ink flowing inside the inflection portion 46C (at the left side of FIG. 8) is slower than the flow speed of the ink flowing outside the inflection portion 46C (at the right side of FIG. 8). Note that in FIG. 8, the flow speed of the ink is depicted according to the size of a black arrow. Therefore, it is conceivable that the number of air bubbles flowing per unit time is larger on the outside of the inflection portion 46C where the flow speed is fast (on the right side of FIG. 8) than on the inside of the inflection portion 46C where the flow speed is slow (on the left side of FIG. 8). Taking this into consideration, in FIG. 8, the supply ports 41*a* are arranged in positions near the left ends of the supply manifolds 46 in the left-right direction. By virtue of this, it is possible to reduce the possibility that the air bubbles flowing in the supply manifolds 46 may flow into the supply ports 41*a*.

Figure 9:
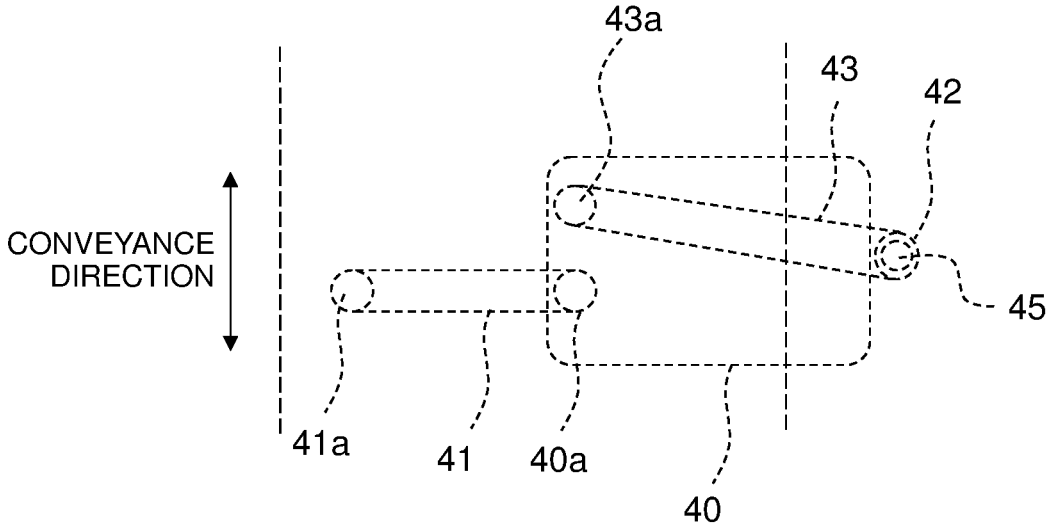
FIG. 9 is an explanatory view showing a positional relation between a nozzle, a supply port, and a feedback port of an ink jet head.

Note that in the above embodiment, the supply port 41*a*, the feedback port 43*a*, the descender portion 42, and the nozzle 45 align in one row in the left-right direction to be positioned at the same level in the conveyance direction. However, the present disclosure is not limited to that. For example, as depicted in FIG. 9, the supply port 41*a*, the feedback port 43*a*, the descender portion 42, and the nozzle 45 may deviate in position in the conveyance direction.

The embodiment and the modified embodiments explained above are merely exemplifications in each and every aspect, and therefore may be changed appropriately. For example, it is possible to set up the number, arrangement, shape, pitch and the like for the pressure chambers 40 in an arbitrary manner and, in accordance with that, to adjust the number, arrangement, shape, pitch and the like for the individual electrodes 144. Further, in the embodiment and the modified embodiments described above, the supply manifolds 46 and the feedback manifolds 47 are arranged to overlap in the up-down direction, but the present disclosure is not limited to that. The supply manifolds 46 and the feedback manifolds 47 may be arranged to align in the left-right direction. Further, the piezoelectric layers 141 and 142 are arranged in the upper part of the flow channel unit 21 to cover all pressure chambers 40. However, the piezoelectric layers 141 and 142 may be divided into a plurality of blocks, for example, for the piezoelectric blocks to cover the plurality of pressure chambers 40 respectively. In such a case, compared to the case where the piezoelectric layers 141 and 142 are divided into individual blocks to cover one pressure chamber 40 with one block, it is still possible to suppress the detachment force arising upward in the supply manifold 46, from the pressure of the ink flowing in the supply manifold 46. Further, while the ink jet head 2 is a so-called line-type ink jet head, the present disclosure is not limited to that but may also apply to so-called serial-type ink jet heads. Further, the present disclosure is not limited to ink jet heads jetting an ink. The present disclosure may also apply to liquid discharge apparatuses used for various purposes other than printing images and the like. For example, it is also possible to apply the present disclosure to liquid discharge apparatuses for forming an electrically conductive pattern on a substrate surface by jetting an electrically conductive liquid onto the substrate.

What is claimed is:

1. A liquid discharge head comprising:

a supply manifold extending in a first direction;

a feedback manifold extending in the first direction;

a plurality of individual flow channels having a plurality of pressure chambers and a plurality of nozzles, each of the individual flow channels having:

a supply portion connecting the supply manifold and one of the plurality of pressure chambers;

a descender portion extending in a second direction orthogonal to the first direction and connecting the one of the plurality of pressure chambers and one of the plurality of nozzles; and a feedback portion branching from the descender portion and connected to the feedback manifold; and a communication flow channel connecting one end of the supply manifold in the first direction and one end of the feedback manifold in the first direction without involving the plurality of pressure chambers and the plurality of nozzles, wherein the supply manifold has a plurality of supply ports connected to the supply portions of the plurality of individual flow channels, and the feedback manifold has a plurality of feedback ports connected to the feedback portions of the plurality of individual flow channels, wherein a distance, in a third direction orthogonal to the first direction and to the second direction, between the center of the supply manifold in the third direction and the plurality of supply ports of the supply manifold is longer than ¼ of a width of the supply manifold in the third direction, and a distance in the third direction between the center of the feedback manifold in the third direction and the plurality of feedback ports of the feedback manifold is shorter than ¼ of a width of the feedback manifold in the third direction, and wherein the supply manifold has a communication port connected to the communication flow channel, and a distance in the third direction between the center of the supply manifold in the third direction and the communication port of the supply manifold is shorter than ¼ of the width of the supply manifold in the third direction.

2. The liquid discharge head according to claim 1, wherein the supply manifold is shorter in length along the second direction than the feedback manifold.

3. The liquid discharge head according to claim 1, wherein each of the plurality of supply ports which is connected to one of the plurality of individual flow channels is smaller in opening area than each of the plurality of feedback ports which is connected to the one of the plurality of individual flow channels.

4. The liquid discharge head according to claim 1, further comprising a feeding port configured to feed a liquid to the supply manifold, and a retrieving port configured to retrieve the liquid from the feedback manifold, the feeding port and the retrieving port being arranged at one side, of the supply manifold and the feedback manifold, in the third direction, wherein the supply manifold and the feedback manifold have inflection portions inflecting at the one side in the third direction toward the feeding port and the retrieving port, and wherein in the third direction, the plurality of supply ports are arranged between the end of the supply manifold at the one side in the third direction and the center of the supply manifold in the third direction.

5. The liquid discharge head according to claim 1, wherein at least part of the supply manifold overlaps with the feedback manifold in the second direction.

6. The liquid discharge head according to claim 5, wherein in each of the individual flow channels, one of the plurality of supply ports of the supply manifold is positioned, in the third direction, between the descender portion and the center of the supply manifold in the third direction.

7. The liquid discharge head according to claim 5, wherein in each of the individual flow channels, the center of the supply manifold in the third direction is positioned, in the third direction, between the descender portion and one of the plurality of supply ports of the supply manifold.

8. The liquid discharge head according to claim 5, wherein in each of the individual flow channels, the center of the supply manifold in the third direction is positioned, in the third direction, between one of the plurality of supply ports of the supply manifold and one of the plurality of feedback ports of the feedback manifold.

9. The liquid discharge head according to claim 5, wherein in each of the individual flow channels, one of the plurality of supply ports of the supply manifold and one of the plurality of feedback ports of the feedback manifold are arranged to deviate in position from each other in the first direction.

10. The liquid discharge head according to claim 1, wherein in each of the individual flow channels, one of the plurality of supply ports of the supply manifold is positioned, in the third direction, between an end of the supply manifold in the third direction and the center thereof in the third direction.

11. The liquid discharge head according to claim 1, wherein in each of the individual flow channels, one of the plurality of feedback ports of the feedback manifold is positioned, in the third direction, between the center of the feedback manifold in the third direction and the descender portion.

12. The liquid discharge head according to claim 1, further comprising a piezoelectric layer arranged to overlap with the plurality of pressure chambers in the second direction, wherein at least a part of the supply manifold overlaps with the feedback manifold in the second direction.

13. The liquid discharge head according to claim 12, wherein a liquid flowing in the supply manifold is larger in pressure than the liquid flowing in the feedback manifold.

14. The liquid discharge head according to claim 12, wherein the piezoelectric layer is arranged to overlap in the second direction with all of the individual flow channels including all of the plurality of pressure chambers, the supply manifold, and the feedback manifold.

15. The liquid discharge head according to claim 12, further comprising: a plurality of individual electrodes arranged on a first surface of the piezoelectric layer to overlap in the second direction with the plurality of pressure chambers, and a common electrode arranged on a second surface of the piezoelectric layer that is opposed to the first surface in the second direction, the common electrode facing the plurality of individual electrodes, wherein in the second direction, each of the individual electrodes covers an end portion of the supply manifold in the third direction.

16. A liquid discharge apparatus comprising:

the liquid discharge head according to claim 1;

a driver IC provided to supply a first potential to a common electrode, and to selectively supply the first potential and a second potential different from the first potential to a plurality of individual electrodes; and a controller configured to control the driver IC, wherein in a case that liquid droplets are not discharged from a nozzle corresponding to one of the individual electrodes, the controller controls the driver IC to supply the second potential to the one of the individual electrodes, wherein in a case that liquid droplets are discharged from the nozzle corresponding to the one of the individual electrodes, the controller controls the driver IC to supply the first potential to the one of the individual electrodes and then supply the second potential to the one of the individual electrodes again.

* * * * *